US007567683B2

(12) United States Patent
Akino

(10) Patent No.: US 7,567,683 B2
(45) Date of Patent: Jul. 28, 2009

(54) MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 800 days.

(21) Appl. No.: 11/204,087

(22) Filed: Aug. 16, 2005

(65) Prior Publication Data

US 2006/0040543 A1 Feb. 23, 2006

(30) Foreign Application Priority Data

Aug. 18, 2004 (JP) ..... 2004-238268

(51) Int. Cl.
*H04R 25/00* (2006.01)

(52) U.S. Cl. ..... 381/361; 381/355; 381/362

(58) Field of Classification Search ..... 381/91, 381/355, 361, 362, 363, 366, 368, 189, 122; 248/636, 638
See application file for complete search history.

(56) References Cited

U.S. PATENT DOCUMENTS 2,579,162 A * 12/1951 Veneklasen ..... 381/174
5,988,585 A * 11/1999 Eaton ..... 248/638
2005/0226450 A1* 10/2005 Akino ..... 381/361

* cited by examiner

*Primary Examiner*—Huyen D Le
(74) *Attorney, Agent, or Firm*—Manabu Kanesaka

(57) ABSTRACT

In a microphone in which a protective sleeve is put around a connector housing section of a microphone grip, and a connection plug on the microphone cable side is detachably connected to the connector housing section, the protective sleeve and the connection plug are fixed surely to the connector housing section with a push machine screw. In a microphone in which a microphone unit is supported on the front end side thereof; a microphone grip 10 having the connector housing section 12 on the rear end side thereof is included; the protective sleeve 30 consisting of a rubber elastic element is detachably fitted around the connector housing section 12; and the connection plug 21 on the microphone cable 20 side is detachably connected to the connector housing section 12, the connector housing section 12 is formed with an internally threaded hole **12*b* with which a push machine screw 40 for preventing the connection plug 21 from coming off is threadedly engaged, and the protective sleeve 30 is formed with a machine screw holding hole 31 for holding the push machine screw 40 by means of rubber elasticity so that the push machine screw 40 is incapable of coming off, the machine screw holding hole 31 being aligned coaxially with the internally threaded hole 12*b***.

3 Claims, 4 Drawing Sheets

MICROPHONE

TECHNICAL FIELD

The present invention relates to a hand-held microphone connected detachably with a microphone cable and, more particularly, to a means for preventing the microphone cable from coming off.

BACKGROUND ART

For a hand-held microphone used, for example, on a stage, considering the ease of installation and withdrawal, a type in which a microphone can be attached to and detached from a microphone cable via a connector has preferably been used. One example thereof is explained with reference to FIG. 4.

This microphone has a microphone grip 10 formed into a cylindrical shape because it is used in a hand-held manner. On the front end side of the microphone grip 10, a microphone unit, not shown, is supported, and to protect the microphone unit, a guard mesh 11 consisting of, for example, a wire mesh element is installed on the front end side of the microphone grip 10.

On the rear end side of the microphone grip 10, a connector housing section 12 is provided integrally, and a connector 13 is housed in the connector housing section 12. In many cases, as the connector 13, a three-pin type connector specified in EIAJ RC-5236 "Audio latch lock round type connector" is used.

When the microphone is in use, a connection plug 21 on the microphone cable 20 side is inserted in the connector housing section 12, by which the connection plug 21 is connected to the connector 13. The connection plug 21 is provided with a latch claw 23 operated so as to be projected and retracted by a push knob 22, and on the connector housing section 12 side, a locking hole 12*a* serving as the mate of the latch claw 23 is formed.

The latch claw 23 is projected in a normal state by a spring means, not shown. Therefore, when the connection plug 21 is inserted compulsorily into the connector housing section 12, the latch claw 23 enters into the locking hole 12*a*, by which the connection plug 21 is locked automatically. When the locking due to the latch claw 23 is released by pushing the push knob 22, the connection plug 21 can be removed.

The hand-held microphone is often dropped onto a floor surface etc. as compared with other types of microphones. In particular, if the microphone drops in a state in which the connector housing section 12 is on the downside and the microphone cable 20 is not connected, the connector housing section 12 is deformed by the shock, and resultantly the connection plug 21 cannot be inserted.

Also, the connection plug 21 is locked in the connector housing section 12 by the latch claw 23. For example, when the microphone is used for a vocal use on a stage etc., the push knob 22 is sometimes pushed mistakenly, and hence the connection plug 21 comes off. At this time, much noise is produced.

Thereupon, to protect the connector housing section 12 from a drop shock, a method has been used in which a protective sleeve 30 consisting of a rubber elastic element is put around the connector housing section 12. Also, in order to prevent the connection plug 21 from coming off due to misoperation of the push knob 22, a detachment regulating adapter has only to be installed around the push knob 22 as described in, for example, Japanese Utility Model Application Publication No. H06-85592.

However, the detachment regulating adapter is a part which is attached afterward to the connection plug 21, so that it has a problem in that not only the attachment/detachment thereof is troublesome but also it is lost easily.

Also, the protective sleeve 30 sometimes slips at the time of attachment/detachment of the connection plug 21, and thus comes off the connector housing section 12 inadvertently. In order to prevent the coming-off, the protective sleeve 30 has only to be fixed to the connector housing section 12 with an adhesive etc., but this method poses a problem as described below.

First, when the hand-held microphone is used in a state of being held on a microphone stand, the protective sleeve 30 hinders the mounting of the microphone on some microphone stand. Therefore, it is necessary to configure the microphone so that the protective sleeve 30 can be removed at any time.

Next, the connector 13 is connected electrically and mechanically to the connector housing section 12 by pushing the connector 13 against the internal surface of the connector housing section 12 by turning an incorporated male screw 13*a* with a screwdriver. In some cases, the connector 13 must be removed for maintenance, so that it is unfavorable to bondingly fix the protective sleeve 30.

SUMMARY OF THE INVENTION

Accordingly, a problem of the present invention is that in a microphone in which a protective sleeve is put around a connector housing section, and a connection plug on the microphone cable side is detachably connected to the connector housing section, the protective sleeve can be held around the connector housing section by a very simple means in a state of being detachable, and also the connection plug can be fixed surely in the connector housing section.

To solve the above problem, the present invention provides a microphone in which a microphone unit is supported on the front end side thereof; a cylindrical microphone grip having a connector housing section on the rear end side thereof is included; a protective sleeve consisting of a rubber elastic element is detachably fitted around the connector housing section; and a connection plug on the microphone cable side is detachably connected to a connector in the connector housing section, wherein the connector housing section is formed with an internally threaded hole with which a push machine screw for preventing the connection plug from coming off is threadedly engaged, and the protective sleeve is formed with a machine screw holding hole for holding the push machine screw by means of rubber elasticity so that the push machine screw is incapable of coming off, the machine screw holding hole being aligned coaxially with the internally threaded hole.

In the present invention, the push machine screw preferably has a length capable of covering the total depth of both of the internally threaded hole and the machine screw holding hole. According to this configuration, even if the prevention of the connection plug from coming off is canceled, the protective sleeve is held around the connector housing section via the push machine screw.

According to the present invention, at least one push machine screw surely enables the protective sleeve to be held around the connector housing section and the connection plug to be prevented from coming off. Also, even if the protective sleeve is removed from the connector housing section, the push machine screw is held in the machine screw holding hole in the protective sleeve, so that there is no fear that the push machine screw comes off or is lost.

DETAILED DESCRIPTION

Figure 1:
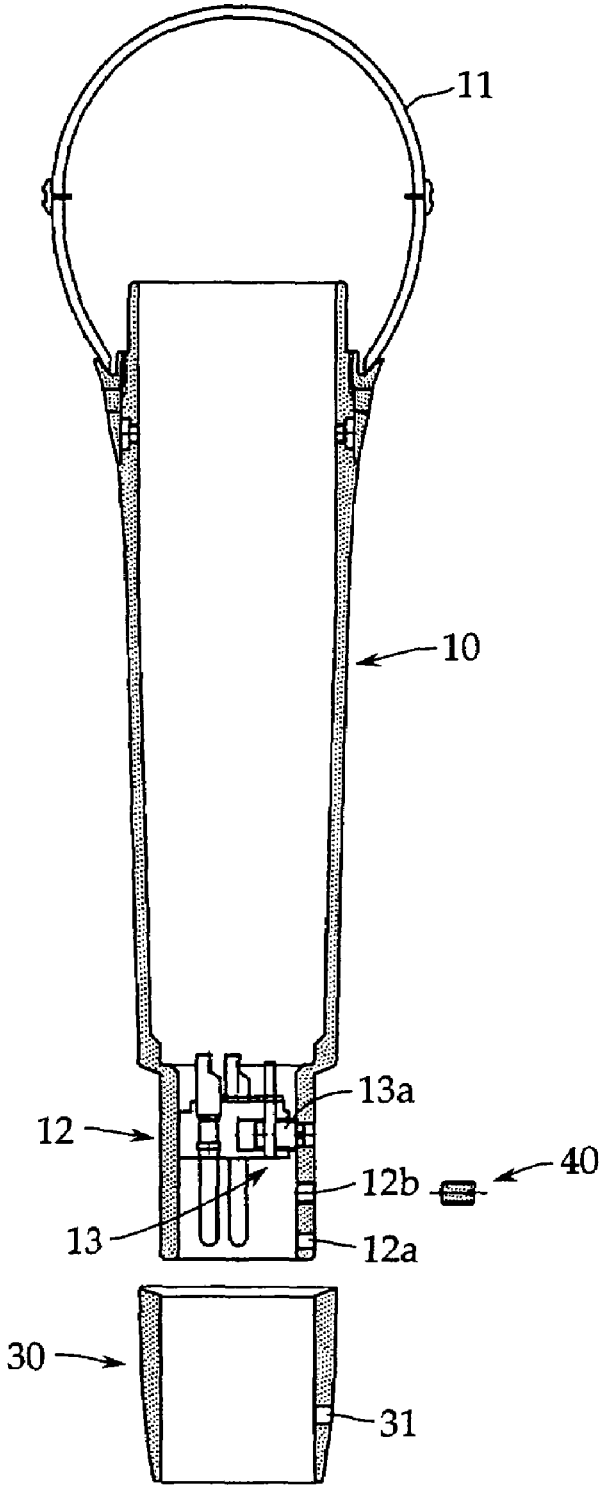
FIG. 1 is a sectional view explodedly showing a principal portion of a microphone in accordance with the present invention.
Figure 2:
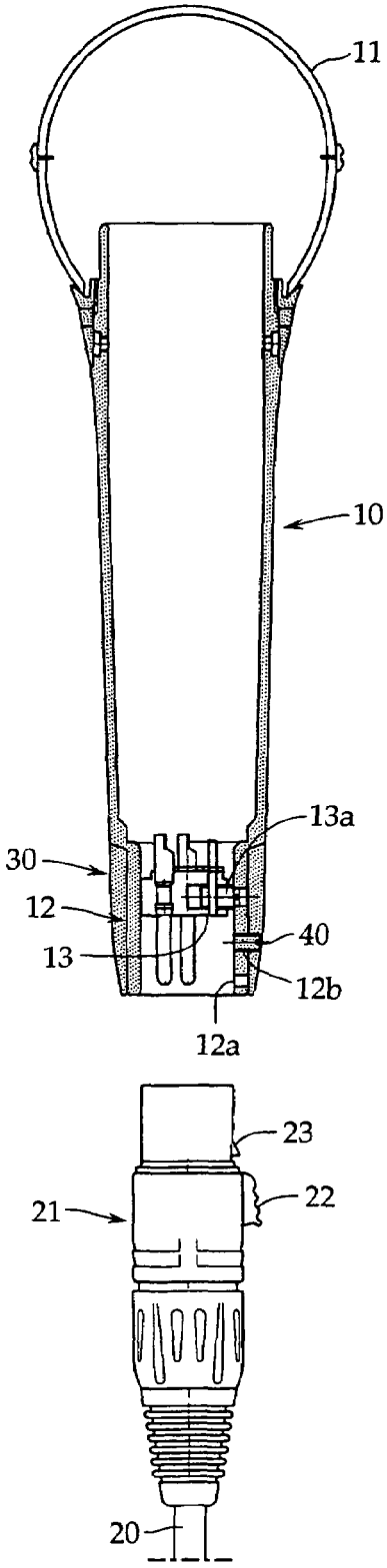
FIG. 2 is a sectional view showing a state in which a protective sleeve is fixed in the present invention.
Figure 3:
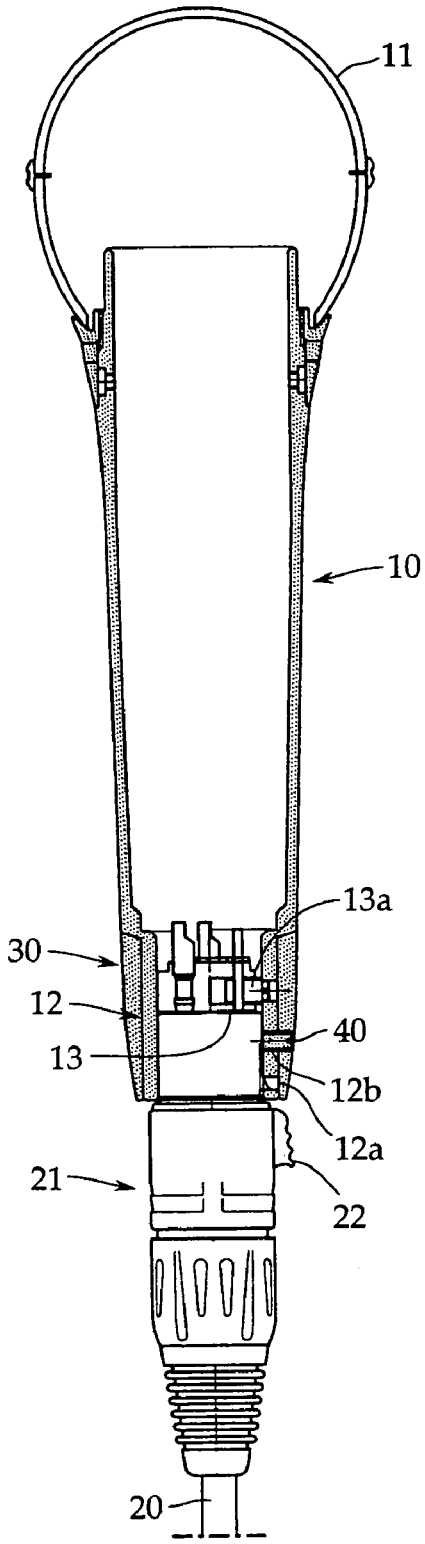
FIG. 3 is a sectional view showing a state in which a connection plug is fixed in the present invention.
Figure 4:
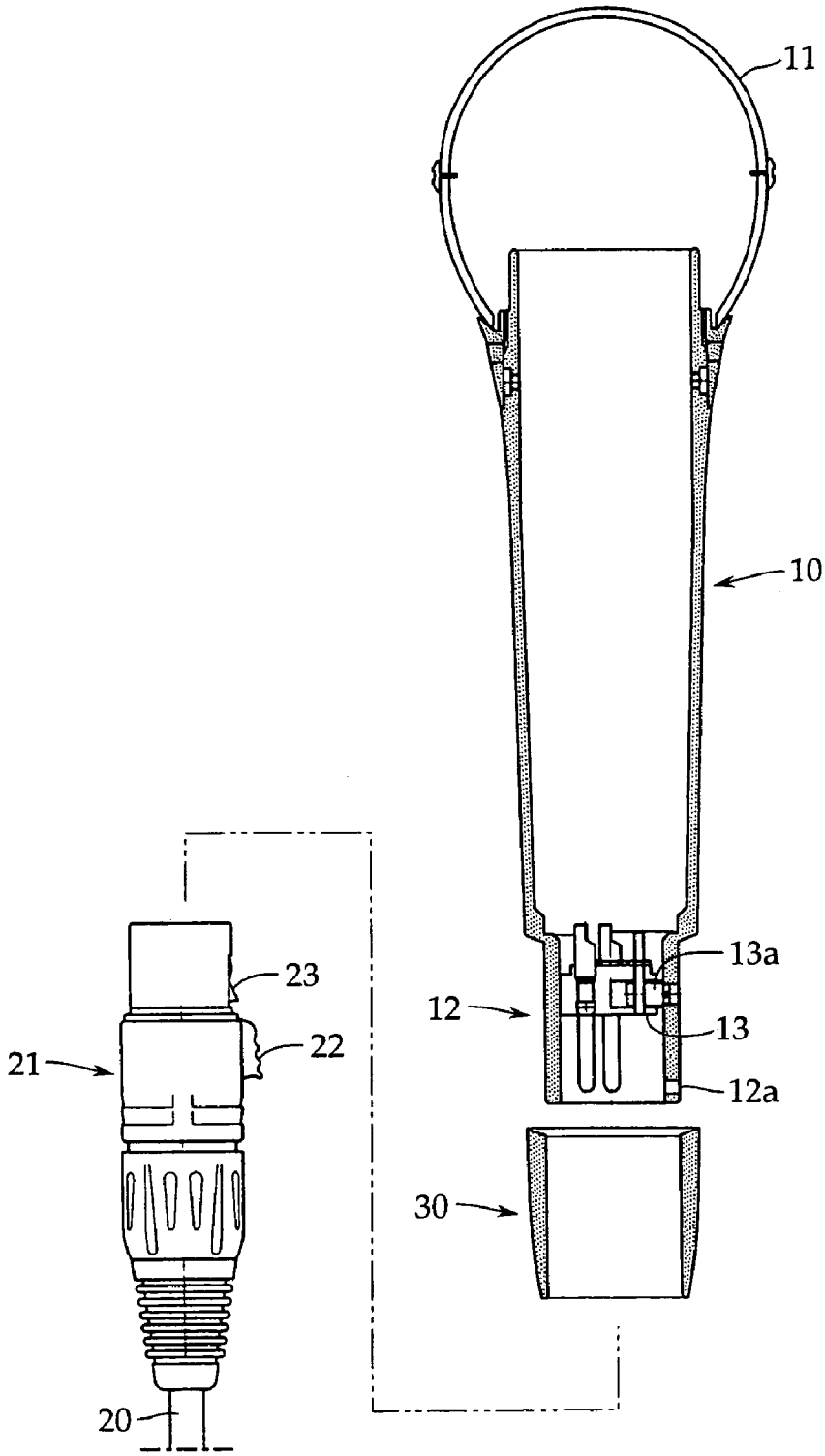
FIG. 4 PRIOR ART
FIG. 4 is a sectional view explodedly showing a conventional example.

An embodiment of the present invention will now be described with reference to FIGS. 1 to 3. The present invention is not limited to the embodiment described below. FIG. 1 is a sectional view explodedly showing a principal portion of a microphone in accordance with the present invention, FIG. 2 is a sectional view showing a state in which a protective sleeve is fixed, and FIG. 3 is a sectional view showing a state in which a connection plug is fixed. In these figures, the same reference numerals are applied to elements that need not be changed especially from the elements included in the conventional example explained with reference to FIG. 4.

First, referring to FIG. 1, since a microphone in accordance with the present invention is used in a hand-held manner, it is provided with a microphone grip 10 formed into a cylindrical shape. The microphone grip 10 is made usually of a metal such as brass alloy or aluminum, but in some cases, it is made of a synthetic resin.

On the front end side of the microphone grip 10, a microphone unit, not shown, is supported, and to protect the microphone unit from a mechanical shock, a guard mesh 11 consisting of a wire mesh is put on the front end side of the microphone grip 10. In the case of the hand-held microphone, a dynamic microphone unit is usually used, but a condenser microphone unit may also be used.

On the rear end side of the microphone grip 10, a connector housing section 12 of a cylindrical shape is provided integrally, and a connector 13 is housed in the connector housing section 12. The connector 13 may be a three-pin type connector specified in EIAJ RC-5236 "Audio latch lock round type connector" as in the conventional example explained before.

As shown in FIGS. 2 and 3, a connection plug 21 on the microphone cable 20 side is inserted in the connector housing section 12, by which the connection plug 21 is connected to the connector 13. The connection plug 21 is also the same as that in the conventional example explained before. Specifically, the connection plug 21 is provided with a latch claw 23 operated so as to be projected and retracted by a push knob 22, and on the connector housing section 12 side, a locking hole 12*a* serving as the mate of the latch claw 23 is formed.

Referring again to FIG. 1, a protective sleeve 30 is put around the connector housing section 12 to protect the connector housing section 12 from a drop shock. Although the connector housing section 12 is formed so as to have a diameter a size smaller than that of the microphone grip 10 in this example, the connector housing section 12 may have the same diameter as that of the microphone grip 10.

According to the present invention, the connector housing section 12 is formed with an internally threaded hole 12*b* for projecting and retracting a push machine screw 40 toward and from the interior of the connector housing section 12. Also, the protective sleeve 30 is formed with a machine screw holding hole 31 for holding the push machine screw 40 by means of rubber elasticity so that the push machine screw 40 is incapable of coming off, the machine screw holding hole 31 being aligned coaxially with the internally threaded hole 12*b*.

The machine screw holding hole 31 has only to be a simple through hole having a hole diameter slightly smaller than the diameter of the push machine screw 40. By compulsorily screwing the push machine screw 40 in the machine screw holding hole 31 and by engaging the push machine screw 40 with the internally threaded hole 12*b*, the protective sleeve 30 can be fixed to the connector housing section 12 via the push machine screw 40 as shown in FIG. 2. As seen from the above description, it is preferable that the length of the push machine screw 40 be a length that can cover the total depth of both of the internally threaded hole 12*b* and the machine screw holding hole 31.

When the microphone is in use, the connection plug 21 on the microphone cable 20 side is inserted in the connector housing section 12. In the case where it is attempted to prevent the connection plug 21 from coming off the connector housing section 12 even if the locking due to the latch claw 23 is released by pushing the push knob 22 mistakenly during the use, the push machine screw 40 is further turned, and is strongly pushed against the connection plug 21 as shown in FIG. 3. Thereby, the connection plug 21 can surely be prevented from coming off.

When the connection plug 21 is removed, it is necessary only that the push machine screw 40 be turned reversely and hence be withdrawn into the internally threaded hole 12*b*. Also, if the protective sleeve 30 becomes a hindrance, for example, when the microphone is mounted on a microphone stand, not shown, or if there is a need for removing the protective sleeve 30 from the connector housing section 12 for the purpose of maintenance, the push machine screw 40 has only to be turned further reversely to be disengaged from the internally threaded hole 12*b*.

Even if the push machine screw 40 is disengaged from the internally threaded hole 12*b* in this manner, the push machine screw 40 is held in the machine screw holding hole 31 unless the push machine screw 40 is intentionally pulled out of the machine screw holding hole 31, so that there is no fear that the push machine screw 40 is lost.

The present application is based on, and claims priority from, Japanese Application Serial Number JP2004-238268, filed Aug. 18, 2004, the disclosure of which is hereby incorporated by reference herein in its entirety.

The invention claimed is:

1. A microphone comprising:

a cylindrical microphone grip having a connector housing section on a rear side thereof, said connector housing section having a connector therein and an internally threaded hole, a microphone unit supported on a front side of the microphone grip, a connection plug for a microphone cable, detachably connected to the connector in the connector housing section, a push machine screw threadably engaging the threaded hole to be able to contact the connection plug for preventing the connection plug from coming off from the connector, and a protective sleeve formed of a rubber elastic element and having a machine screw holding hole therein, said protective sleeve being detachably fitted around the connector housing section so that the machine screw holding hole is aligned radially with the threaded hole and being securely fitted around the connector housing when the push machine screw engages the connector housing section through the machine screw holding hole, said machine screw holding hole having a diameter smaller than that of the push machine screw for holding the push machine screw therein by means of rubber elasticity so that the push machine screw is held in the protective sleeve when the push machine screw is only retained in the machine screw holding hole.

2. The microphone according to claim 1, wherein said push machine screw has a length extending throughout an entire length of both the threaded hole and the machine screw holding hole.

3. The microphone according to claim 2, wherein said machine screw holding hole is a simple through hole.

* * * * *